US007490748B2

(12) United States Patent
Komazaki

(10) Patent No.: US 7,490,748 B2
(45) Date of Patent: Feb. 17, 2009

(54) PNEUMATICALLY OPERATED FASTENER DRIVING TOOL

(75) Inventor: Yoshiichi Komazaki, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 57 days.

(21) Appl. No.: 11/761,390

(22) Filed: Jun. 12, 2007

(65) Prior Publication Data

US 2007/0290021 A1 Dec. 20, 2007

(30) Foreign Application Priority Data

Jun. 14, 2006 (JP) ..... P2006-164157

(51) Int. Cl.
*B25C 1/04* (2006.01)

(52) U.S. Cl. ..... 227/130; 227/8

(58) Field of Classification Search ..... 227/130, 227/8, 10, 120, 136; 173/210, 211
See application file for complete search history.

(56) References Cited

U.S. PATENT DOCUMENTS 4,404,894 A * 9/1983 Oesterle ..... 91/461
4,867,366 A * 9/1989 Kleinholz ..... 227/66
4,932,480 A * 6/1990 Golsch ..... 173/210
5,110,030 A * 5/1992 Tanji ..... 227/130
5,259,465 A * 11/1993 Mukoyama ..... 173/168
5,725,142 A * 3/1998 Hamada ..... 227/130
5,878,936 A * 3/1999 Adachi et al. ..... 227/130
5,927,584 A * 7/1999 Akiba ..... 227/130
7,014,089 B2 * 3/2006 Ishizawa et al. ..... 227/130
7,290,691 B1 * 11/2007 Wen ..... 227/8
7,377,413 B2 * 5/2008 Wen ..... 227/8

FOREIGN PATENT DOCUMENTS

JP 2001-162557 6/2001

* cited by examiner

*Primary Examiner*—Scott A. Smith
(74) *Attorney, Agent, or Firm*—Antonelli, Terry, Stout & Kraus, LLP.

(57) ABSTRACT

A pneumatically operated fastener driving tool capable of avoiding accidental release of a head bumper from a housing. The head bumper is made from an elastic material and is compressedly fitted to the housing. The head bumper has a contacting portion deflectable upon application of compressed air. A discharge port is formed at one of the housing and the head bumper to discharge the applied compressed fluid to an atmosphere.

8 Claims, 4 Drawing Sheets

RELATED ART

PNEUMATICALLY OPERATED FASTENER DRIVING TOOL

BACKGROUND OF THE INVENTION

The present invention relates to a fastener driving tool such as a nail gun driven by compressed air, and more particularly, to an arrangement that avoids accidental release of a head bumper.

Generally, in a conventional pneumatically operated fastener driving tool, a piston slidably movable in a cylinder is pneumatically driven to its bottom dead center for driving a faster into a workpiece. The piston strikes against a bumper disposed at a lower end of a cylinder, and further, the piston strikes against a head bumper positioned above the cylinder during upward moving stroke of the piston. These bumpers are formed of an elastic material for absorbing shock imparted by the piston. Such arrangement is disclosed in, for example, laid-open Japanese Patent Application Kokai No. 2001-162557.

Conventionally, the head bumper is axially compressedly and concentrically fitted over a shaft protruding downwardly from a top wall region of a main housing. A release of the head bumper from the shaft has been recognized.

SUMMARY OF THE INVENTION

It is therefore an object of the present invention is to provide a pneumatically operated fastener driving tool capable of avoiding accidental release of the head bumper from the main housing.

This and other objects of the present invention will be attained by a pneumatically operated fastener driving tool including a housing, a cylinder, a piston, a head bumper, and a sleeve valve. The housing has a top wall region provided with a shaft. The cylinder is disposed within the housing. The piston is reciprocally slidably disposed within the cylinder. The piston is movable between its top dead center and a bottom dead center. The piston bumps against the head bumper when the piston is moved toward its top dead center. The head bumper is made from an elastic material and has a fitting portion elastically fitted over the shaft and a contacting portion integral with the fitting portion. The contacting portion has one end surface in contact with the top wall region and an outer peripheral surface. The sleeve valve is movable in a moving direction of the piston between a first position and a second position. The sleeve valve has an inner peripheral surface part in contact with the outer peripheral surface of the contacting portion and has one axial end in contact with the top wall region when the sleeve valve is positioned at the first position. The contacting portion is deflectable when the inner peripheral surface part is slidingly moved from the first position toward the second position with respect to the outer peripheral surface of the contacting portion. A discharge port is formed to allow a compressed fluid entered between the top wall region and the contacting portion to be discharged to an atmosphere.

In another aspect of the invention, there is provided a pneumatically operated fastener driving tool including a housing, a head bumper, a cylinder, a piston, and a sleeve valve. The housing has a top wall and defines therein an accumulation chamber that accumulates a compressed fluid. The head bumper is made from an elastic material and is attached to the top wall. The cylinder is disposed within the housing. The piston is reciprocally slidably disposed within the cylinder. The sleeve valve is movable in a moving direction of the piston between a first position and a second position. The accumulation chamber is fluidly disconnected from an interior of the cylinder in the first position, and the accumulation chamber is fluidly connected to the interior of the cylinder in the second position to apply the compressed fluid into the interior. A discharge port is formed to allow the compressed fluid entered between the top wall and the head bumper to be discharged to an atmosphere.

DETAILED DESCRIPTION OF THE PREFERRED EMBODIMENTS

Figure 1:
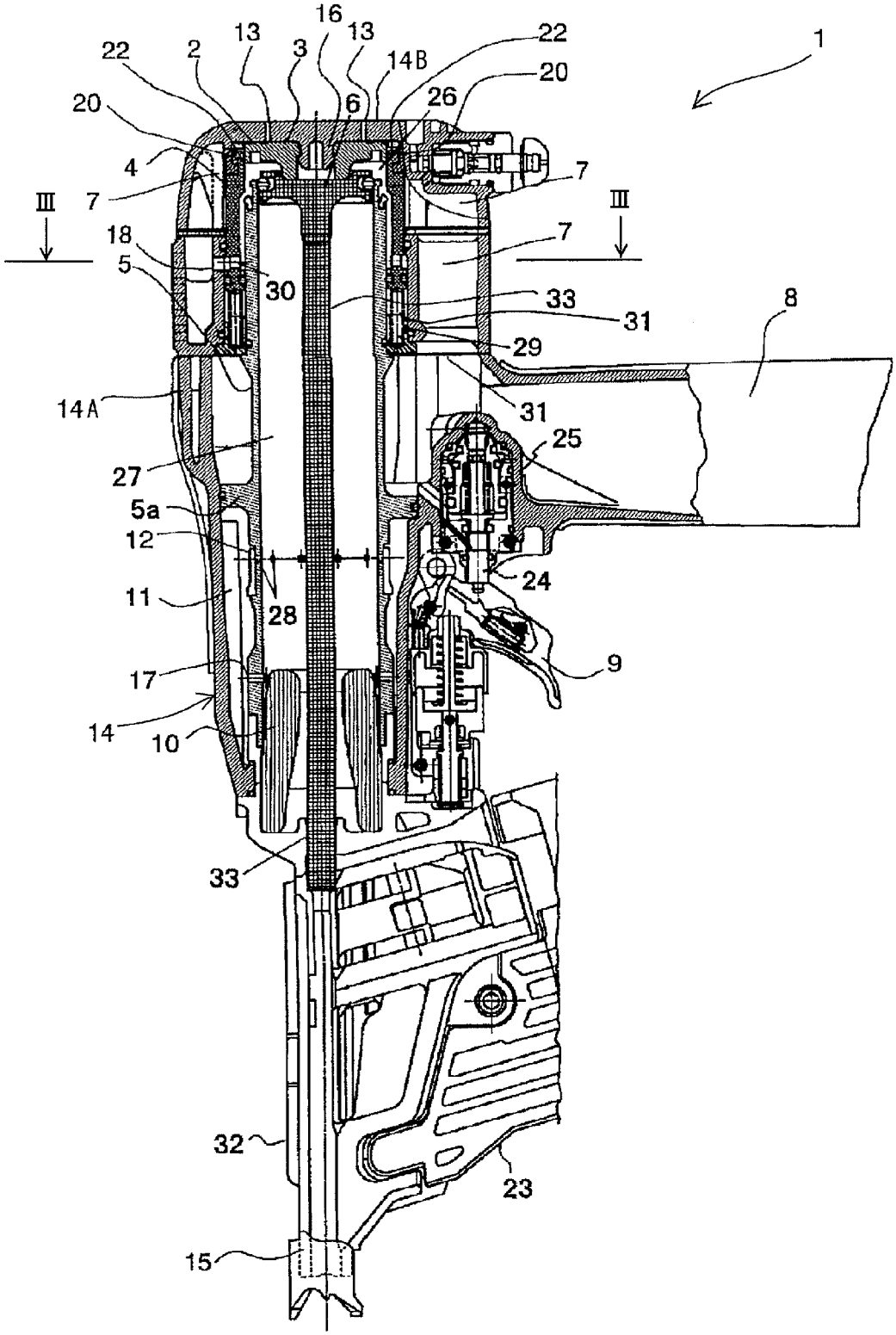
FIG. 1 is a cross-sectional view of a pneumatically operated fastener driving tool according to a first embodiment of the present invention.

A pneumatically operated fastener driving tool according to a first embodiment of the present invention will be described with reference to FIGS. 1 through 4. The fastener driving tool shown in FIG. 1 is a nail gun 1 which uses compressed air as the power source. The nail gun 1 includes a generally T-shaped housing 14 in which an accumulation chamber 7 is formed. The housing 14 includes a main housing 14A and a handle 8 extending therefrom. The handle 8 has an end portion provided with an air plug (not shown) to which an air hose (not shown) is connected for introducing a compressed air into the accumulation chamber 7. A nose 32 is disposed at a lower end of the main housing 14A for guiding a fastener.

A cylinder 5 is provided within the main housing 14A, and a piston 6 is reciprocally slidably movably provided within the cylinder 5. A drive bit 33 is provided integrally with the piston 6, and has a free end for abutting against the fastener set in the nose 32. The piston 6 divides an internal space of the cylinder 5 into upper chamber 26 and a lower chamber 27. A bumper 10 formed of an elastic material such as a rubber is provided at a bottom of the cylinder 5 for dampening impact when the piston 6 bumps against the bumper 10.

The cylinder 5 has an outer flange portion 5*a* (contacting portion) protruding radially outwardly to an inner surface of the main housing 14A. A return chamber 11 is partitioned by the flange portion, the main housing 14A, and the lower outer peripheral surface of the cylinder 5. The return chamber 11 is adapted for accumulating therein a compressed air to return the piston 6 to its upper dead center. Upper air vent holes 28 are formed in an area of the cylinder 6, the area providing the return chamber 11. Further, lower air vent holes 17 are also formed in the area. These air vent holes 28 and 17 are arrayed in a circumferential direction of the cylinder 5. A one-way valve 12 is provided over each upper air vent hole 28 for allowing compressed air in the upper chamber 26 to flow into the return chamber 11 when the piston 6 is positioned below the upper air vent holes 28.

A control valve 25 including a plunger 24 is provided at a base end portion of the handle 8. A trigger 9 is pivotally movably attached to the main housing 14A to move the plunger 24. A push lever 15 movably projects from the bottom of the nose 32 and extends to the vicinity of the control valve 25. The push lever 15 is movable along the nose 32 and is biased away from the main housing 14A. As is well known in the art, the structure is such that, when both the trigger 9 is pulled and the push lever 15 is pressed against a workpiece, a plunger 24 on the control valve 25 can be pushed upward. A magazine 23 is connected to the nose 32. The magazine 23 is loaded with fasteners arrayed side by side.

A sleeve valve 4 is disposed at an upper portion of the main housing 14A. The sleeve valve 4 is movable along an outer peripheral surface of the cylinder 5, and is biased toward a top wall region 14B of the main housing 14A by a spring 29. The sleeve valve 4 has a peripheral wall formed with an exhaust port 30 (see also FIG. 3). Further, the main housing 14A is formed with an exhaust opening 18 at a position near the exhaust port 30. The exhaust port 30 is in selective communication with the exhaust opening 18 in accordance with the movement of the sleeve valve 4. A sleeve valve chamber 31 is positioned immediately below the sleeve valve 31 and is defined by the sleeve valve 4, the main housing 14A and the cylinder 5. The sleeve valve chamber 31 is communicated with the control valve 25 through an air passage (not shown).

A shaft 16 is integrally suspended from the top wall region 14B of the main housing 14A at a center portion thereof. A head bumper 2 formed of an elastic material such as a urethane rubber and a nitrile rubber is fitted over the shaft 16. The fitting of the head bumper 2 is maintained by its compression in its axial direction.

Figure 2:
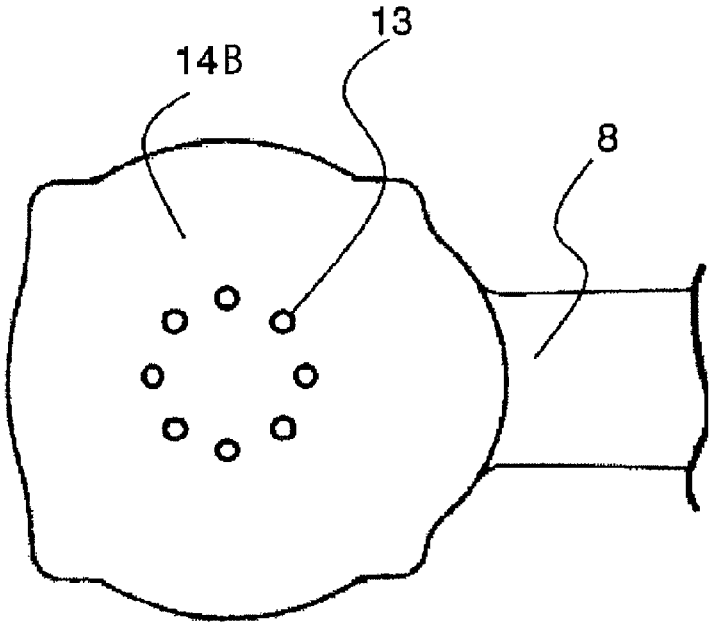
FIG. 2 is a plan view of the tool according to the first embodiment.
Figure 3:
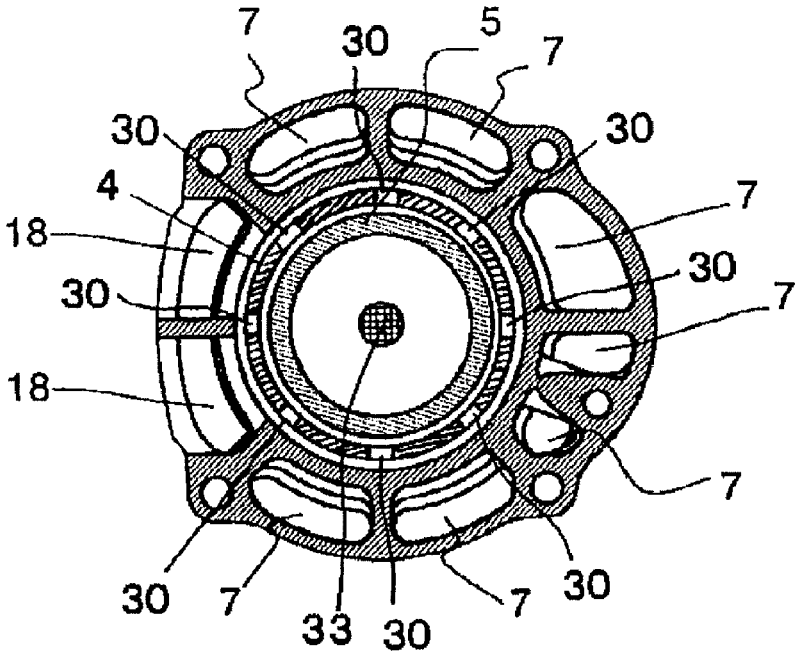
FIG. 3 is a cross-sectional view taken along the line III-III in FIG. 1.

The head bumper 2 includes a sleeve portion (fitting portion) whose inner surface is in intimate contact with an outer peripheral surface of the shaft 16, and a flange portion in contact with an inner surface of the top wall region 14B. As best shown in FIG. 2, a plurality of discharge ports 13 (eight ports) are formed in the top wall region 14B within a region of the flange portion of the head bumper 2. The discharge ports 13 are arrayed in an identical circle with a constant angular pitch (45 degrees). A boundary region 3 between the head bumper 2 and the top wall region 14B of the main housing 14A is in communication with an atmosphere through the discharge ports 13.

For fastener driving operation, the operator connects the air hose to the air plug, and connects the air hose to a compressor (not shown) in order to introduce compressed air into the accumulation chamber 7.

During initial state prior to nail driving operation, as shown in FIG. 1, the sleeve valve 4 is at its top dead center such that an upper end of the sleeve valve 4 is in contact with the lower surface of the top wall region 14A as at 22, and an upper inner peripheral surface of the sleeve valve 4 is in contact with the outer peripheral surface of the head bumper 2 as at 20. Because of the sealing function at the portions 22 and 20, fluid communication between the upper chamber 26 of the cylinder 5 and the accumulation chamber 7 is shut off. In this state, since the exhaust port 30 of the sleeve valve 4 is in communication with the exhaust opening 18 of the main housing 14A, and since the upper chamber 26 of the cylinder 5 is in communication with the atmosphere through the exhaust port 30 and the exhaust opening 18, atmospheric pressure is provided in the upper chamber 26.

Furthermore, the sleeve valve chamber 31 is provided below the sleeve valve 4 by the sleeve valve 4, the main housing 14A and the cylinder 5. During OFF state of the control valve 25, i.e., during non-operational phase of the driving tool 1, the accumulation chamber 7 is in communication with the sleeve valve chamber 31 through the control valve 25.

Then, if the operator pulls the trigger 9 and presses the push lever 15 against the workpiece, the control valve 25 is rendered ON, so that the compressed air in the sleeve valve chamber 31 is discharged to the atmosphere through the control valve 25. As a result, the sleeve valve 4 is moved downward along the outer peripheral surface of the cylinder 5 as shown in FIG. 4 against the biasing force of the spring 29 since compressed pressure in the accumulation chamber 7 is applied to the upper end portion of the sleeve valve 4.

Figure 4:
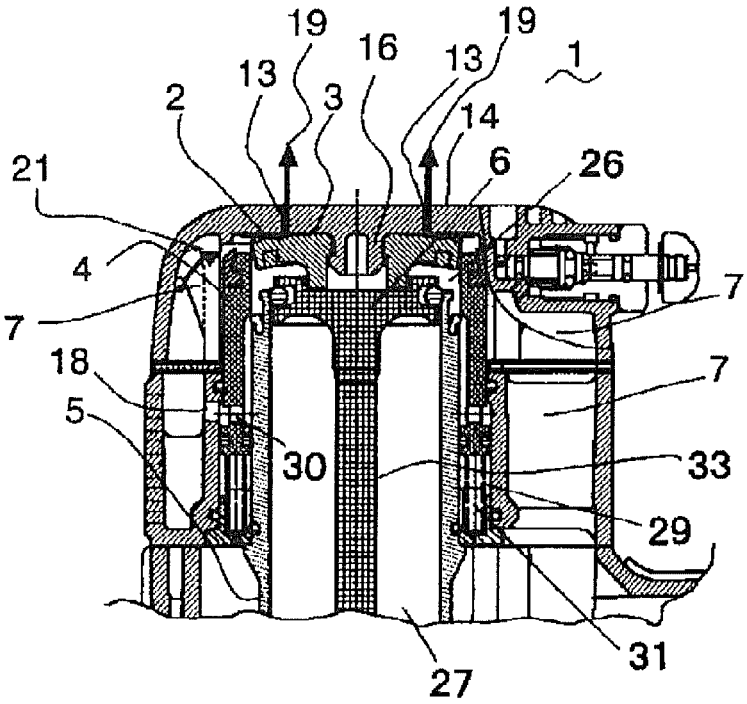
FIG. 4 is a partial cross-sectional view showing an initial start-up state in fastener driving operation according to the first embodiment.

At an initial driving operation where the sleeve valve 4 is slightly moved downward as shown in FIG. 4, the upper inner peripheral surface of the sleeve valve 4 is still in contact with the outer peripheral surface of the flange portion of the head bumper 2, so that the communication between the upper chamber 26 of the cylinder 5 and the accumulation chamber 7 is still shut off. Further, the exhaust port 30 of the sleeve valve 4 is still in communication with the exhaust opening 18 of the main housing 14A, so that the upper chamber 26 is still in communication with the atmosphere.

If degradation of the head bumper 2 has not yet occurred, the entire flange portion of the head bumper 2 can maintain surface contact as at 3 with the top wall region 14B as shown in FIG. 1. Therefore, no gap is provided between the top wall region 14B and the flange portion, and compressed air cannot be entered into the contacting surface 3.

On the other hand, if the head bumper 2 is deformed due to degradation and a gap is provided between the flange portion of the head bumper and the top wall region 14B, compressed air may be entered into the gap as shown in FIG. 4. According to a recent trend, a compact and a lightweight tool is required, which in turn requires high pressure, such as for example about 23 atmospheres, for nail driving operation. Accordingly, excessive load may be imparted to the sealing portion, i.e., the contact regions 20 and 22. Further, because of the repeated fastener driving operation at high speed, for example, driving from 3 to 5 fasters into the workpiece within a second, deformation and heat generation may occur in the head bumper 2 due to repeated collision of the piston 6 against the head bumper 2. As a result, degradation of head bumper 2 occurs to lower sealing relation between the head bumper 2 and the top wall region 14B of the main housing 14A.

However, in the depicted embodiment, the contacting region 3 between the flange portion and the top wall region 14B is communicated with the atmosphere through the discharge ports 13. Therefore, the compressed air entered into the gap can be discharged to atmosphere through the discharge ports 13. Accordingly, atmospheric pressure can be applied to both the upper and lower surfaces of the flange portion. Consequently, any pressure difference is provided between the upper and lower surfaces, so that deformation of the flange portion can be avoided, thereby avoiding release of the head bumper from the shaft 16.

Further, the operator can recognize degradation or any trouble of the head bumper 2 by the discharge of the compressed air through the discharge ports 13. Accordingly, the operator can notice a timing of replacement of the head bumper 2 with a new head bumper 2

If the sleeve valve 4 is further moved downward, the upper chamber 26 is brought into communication with the accumulation chamber 7, and the sleeve valve 4 closes the exhaust opening 18 of the main housing 14A for shutting off fluid communication between the upper chamber 26 and the atmosphere. Accordingly, the upper chamber 26 is filled with the compressed air to rapidly move the piston 6 toward its bottom dead center. Therefore, the drive bit 33 strikes against the fastener supplied from the magazine 23 and set in a fastener injection hole of the nose 32. Consequently, the fastener is driven into the workpiece traveling through the injection hole.

If the piston 6 is moved past the upper air vent holes 28 during its downward moving stroke, compressed air in the upper chamber 26 is introduced and accumulated into the return chamber 11 through the upper vent holes 28 and the one-way valves 12. Further, when the piston 6 reaches its bottom dead center, the piston 6 strikes against the piston bumper 10 to cause elastic deformation of the piston bumper 10. Surplus energy can be absorbed by the deformation.

Next, if the trigger 9 is released or the push lever 15 is moved away from the workpiece, the plunger 24 is returned to its original position to render the control valve 25 OFF. As a result, the sleeve valve 4 is moved upward so that the upper inner peripheral surface of the sleeve valve is brought into contact with the outer peripheral surface of the flange portion of the head bumper 2, and the upper end of the sleeve valve 4 is brought into contact with the lower surface of the top wall region 14B. Thus, contact regions 20 and 22 are provided to shut off fluid communication between the upper chamber 26 and the accumulation chamber 7. Further, the exhaust port 30 is brought into communication with the exhaust opening 18 to communicate the upper chamber 26 with the atmosphere.

As a result, the compressed air accumulated in the return chamber 11 can be introduced into the lower chamber 27 in the cylinder 5 and below the piston 6 through the lower air vent holes 17. Accordingly, the compressed air pressure will be applied to the lower surface of the piston 6 in order to rapidly move the piston 6 toward its top dead center. At the same time, the air in the upper chamber 26 in the cylinder 5 and above the piston 6 will be discharged to atmosphere through the discharge port 30 and the exhaust opening 18, so that the piston 6 can be returned to its initial top dead center position shown in FIG. 1. The piston 6 strikes against the head bumper 2 to cause elastic deformation of the head bumper 2 when the piston 6 reaches the top dead center. Thus, impact force can be absorbed by the head bumper 2. The above-described operation is repeatedly performed, so that each fastener in the magazine 23 can be successively driven into the workpiece.

Figure 6:
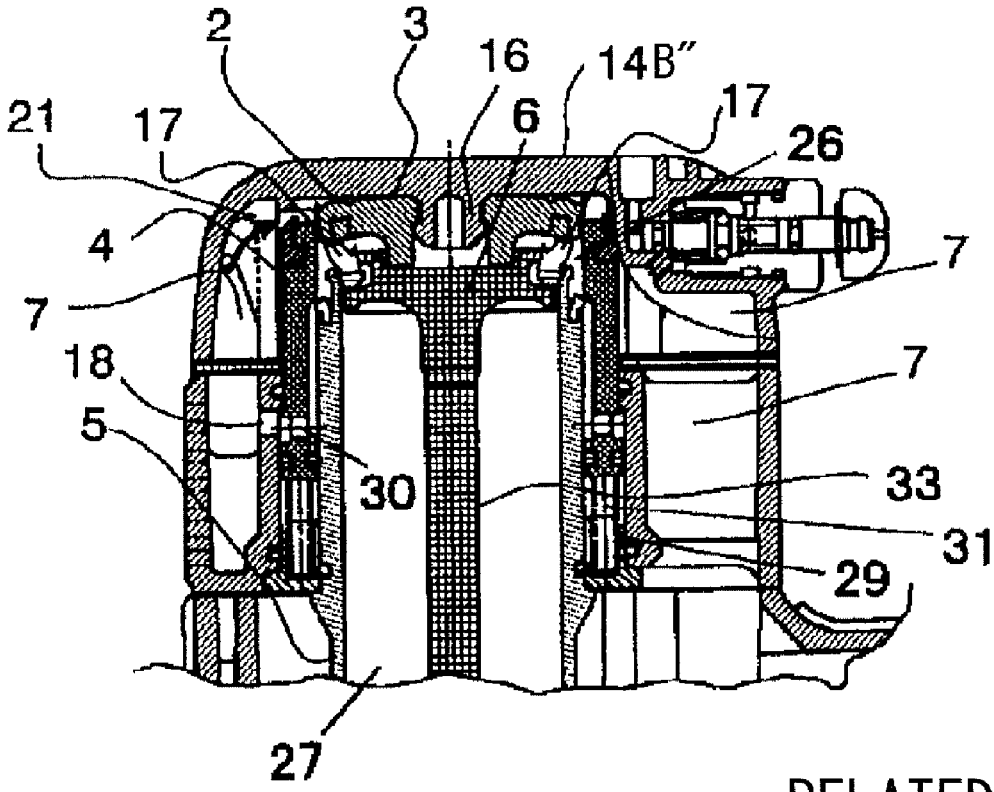
FIG. 6 is a partial cross-sectional view of a pneumatically operated fastener driving tool according to a related art.

As a matter of comparison, a fastener driving tool according to a related art is shown in FIG. 6, in which the above-described discharge ports 13 are not formed in the top wall region 14B'.

As shown in FIG. 6, the head bumper 2 may be deformed or deflected downwardly, if a gap is formed between the head bumper 2 and the top wall region 14B" of the main housing. That is, during initial start-up period of the fastener driving operation, the sleeve valve 4 is slightly moved downwardly so that its upper end is separated from the top wall region 14B", whereas the upper inner peripheral surface of the sleeve valve 4 is still in contact with the outer peripheral surface of the flange portion of the head bumper 2. Thus, fluid communication between the upper chamber 26 and the accumulation chamber 7 is shut off, whereas the exhaust port 30 is communicated with the exhaust opening 18 maintaining atmospheric pressure in the upper chamber 26. In this state, compressed air in the accumulation chamber 7 will be applied to the upper surface of the head bumper 2 through a passage 21. Since the upper surface of the flange portion of the head bumper 2 is subjected to compressed air whereas the lower surface of the flange portion is subjected to atmospheric pressure, the flange portion will be deflected downward due to the pressure difference. Thus, the head bumper 2 may be disengaged from the shaft 16.

The above-described embodiment does not cause such disadvantage because of the formation of the discharge ports 13. The discharge ports 13 can allows the compressed air applied to the upper surface of the flange portion of the head bumper 2 to be discharged outside. Therefore, no pressure difference is provided in the initial start-up period, avoiding release of the head bumper 2 from the shaft 16.

Figure 5:
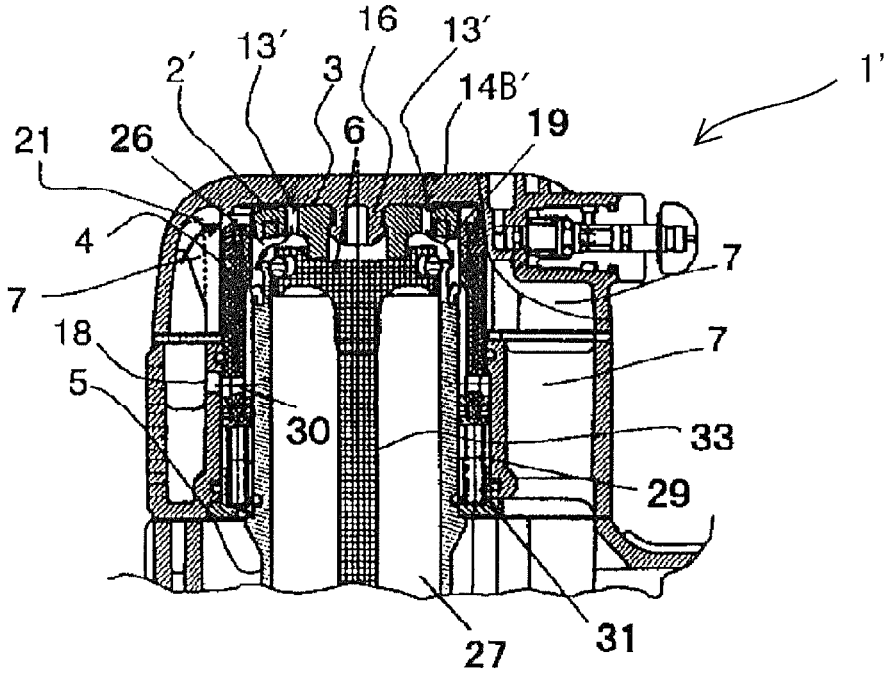
FIG. 5 is a partial cross-sectional view of a pneumatically operated fastener driving tool according to a second embodiment of the present invention.

A fastener driving tool according to a second embodiment of the present invention will be described with reference to FIG. 5, wherein like parts and components are designated by the same reference numerals as those shown in the first embodiment.

In the second embodiment, a top wall region 14B' is not formed with the discharge ports 13 but instead, a head damper 2' is formed with a plurality of discharge ports 13'. More specifically, the discharge ports 13' are formed in the flange portion of the head bumper 2' in a form of a through-hole extending through a thickness of the flange portion. With this arrangement, during the initial start-up period of the fastener driving operation, the compressed air will be applied to the upper surface of the flange portion of the head damper 2' through the passage 21, while the upper chamber 26 is subjected to the atmospheric pressure as described above. In this state, the compressed air applied to the upper surface of the flange portion will be discharged into the upper chamber 26 through the discharge ports 13', and the compressed air will be discharged to the atmosphere through the exhaust port 30 and the exhaust opening 18. Consequently, no pressure difference is provided between the upper and lower surfaces of the flange portion to thus avoid accidental release of the head bumper from the shaft 16.

While the invention has been described in detail and with reference to specific embodiments thereof, it would be apparent to those skilled in the art that various changes and modifications may be made therein without departing from the spirit and scope of the invention. For example, the above described embodiment pertains to the nail gun. However, the present invention is also available for other driving tool for driving a screw or a staple.

What is claimed is:

1. A pneumatically operated fastener driving tool comprising:

a housing having a top wall region provided with a shaft;

a cylinder disposed within the housing;

a piston reciprocally slidably disposed within the cylinder, the piston being movable between its top dead center and a bottom dead center;

a head bumper against which the piston bumps when the piston is moved toward its top dead center, the head bumper being made from an elastic material and having a fitting portion elastically fitted over the shaft and a contacting portion integral with the fitting portion and having one end surface in contact with the top wall region and having an outer peripheral surface; and a sleeve valve movable in a moving direction of the piston between a first position and a second position, the sleeve valve having an inner peripheral surface part in contact with the outer peripheral surface of the contacting portion and has one axial end in contact with the top wall region when the sleeve valve is positioned at the first position;

wherein the contacting portion being deflectable when the inner peripheral surface part is slidingly moved from the first position toward the second position with respect to the outer peripheral surface of the contacting portion;

wherein a discharge port is formed to allow a compressed fluid entered between the top wall region and the contacting portion to be discharged to an atmosphere.

2. The pneumatically operated fastener driving tool as claimed in claim 1, wherein the discharge port is formed at the top wall region.

3. The pneumatically operated fastener driving tool as claimed in claim 2, wherein the discharge port is positioned within an area superposed with the contacting portion.

4. The pneumatically operated fastener driving tool as claimed in claim 3, wherein the housing defines therein an accumulation chamber that accumulates the compressed fluid, and wherein the piston defines an upper chamber within the cylinder and above the piston and a lower chamber within the cylinder and below the piston; and wherein the sleeve valve is formed with an exhaust port and the housing is formed with an exhaust opening in communication with an atmosphere and selectively communicatable with the exhaust port in accordance with the movement of the sleeve valve; and wherein the first position of the sleeve valve permits the upper chamber to communicate with an atmosphere through the exhaust port and the exhaust opening for moving the piston toward the top dead center while blocking communication between the upper chamber and the accumulation chamber, and the second position of the sleeve valve permits the upper chamber to communicate with the accumulation chamber for moving the piston toward the bottom dead center while blocking communication between the upper chamber and the atmosphere.

5. The pneumatically operated fastener driving tool as claimed in claim 1, wherein the discharge port is formed in the contacting portion of the head bumper in a form of a through-hole extending through a thickness of the contacting portion.

6. The pneumatically operated fastener driving tool as claimed in claim 5, wherein the housing defines therein an accumulation chamber that accumulates the compressed fluid, and wherein the piston defines an upper chamber within the cylinder and above the piston and a lower chamber within the cylinder and below the piston; and wherein the sleeve valve is formed with an exhaust port and the housing is formed with an exhaust opening in communication with an atmosphere and selectively communicatable with the exhaust port in accordance with the movement of the sleeve valve; and wherein the first position of the sleeve valve permits the upper chamber to communicate with an atmosphere through the exhaust port and the exhaust opening for moving the piston toward the top dead center while blocking communication between the upper chamber and the accumulation chamber, and the second position of the sleeve valve permits the upper chamber to communicate with the accumulation chamber for moving the piston toward the bottom dead center while blocking communication between the upper chamber and the atmosphere, the compressed fluid introduced between the top wall region and the contacting portion being dischargeable to the atmosphere through the discharge port, the upper chamber, the exhaust port and the exhaust opening.

7. The pneumatically operated fastener driving tool as claimed in claim 1, wherein the head bumper is made from a rubber.

8. A pneumatically operated fastener driving tool comprising:

a housing having a top wall and defining therein an accumulation chamber that accumulates a compressed fluid;

a head bumper made from an elastic material and attached to the top wall;

a cylinder disposed within the housing;

a piston reciprocally slidably disposed within the cylinder; and a sleeve valve movable in a moving direction of the piston between a first position and a second position, wherein the accumulation chamber is fluidly disconnected from an interior of the cylinder in the first position, and the accumulation chamber is fluidly connected to the interior of the cylinder in the second position to apply the compressed fluid into the interior; and wherein a discharge port is formed to allow the compressed fluid entered between the top wall and the head bumper to be discharged to an atmosphere.

* * * * *